US008396229B2

(12) United States Patent
Oz

(10) Patent No.: US 8,396,229 B2
(45) Date of Patent: Mar. 12, 2013

(54) MUSICAL MATERNITY BELT

(75) Inventor: Oren Oz, Modiin (IL)

(73) Assignee: Nuvo Group Ltd., Modiin (IL)

( * ) Notice: Subject to any disclaimer, the term of this patent is extended or adjusted under 35 U.S.C. 154(b) by 1618 days.

(21) Appl. No.: 11/834,085

(22) Filed: Aug. 6, 2007

(65) Prior Publication Data

US 2008/0029333 A1 Feb. 7, 2008

Related U.S. Application Data

(60) Provisional application No. 60/835,897, filed on Aug. 7, 2006.

(51) Int. Cl.
*A41F 9/02* (2006.01)
*G10K 11/00* (2006.01)

(52) U.S. Cl. ..... 381/77; 381/56; 381/57; 381/58; 381/59; 381/301; 381/74; 381/332; 381/333; 600/587; 600/591; 600/27; 600/28; 181/126

(58) Field of Classification Search ..... 381/56, 381/57, 58, 59, 301, 74, 332, 333, 92, 104, 381/336; 600/587, 591, 27, 28; 434/309, 434/322

See application file for complete search history.

(56) References Cited

U.S. PATENT DOCUMENTS

| | | | | | |
|---|---|---|---|---|---|
| 4,830,007 | A * | 5/1989 | Stein | 381/151 |
| 4,964,401 | A * | 10/1990 | Taigen | 482/93 |
| 5,060,639 | A * | 10/1991 | Marcus | 602/19 |
| 5,109,421 | A * | 4/1992 | Fox | 381/333 |
| 5,690,122 | A * | 11/1997 | Weber-Unger | 128/876 |
| 5,873,736 | A * | 2/1999 | Harrison | 434/322 |
| 6,097,822 | A * | 8/2000 | Min | 381/301 |
| 6,709,407 | B2 * | 3/2004 | Fatemi | 600/559 |
| 6,718,044 | B1 * | 4/2004 | Alleyne | 381/336 |
| 6,840,775 | B2 * | 1/2005 | Sailors | 434/236 |
| 2002/0196959 | A1 * | 12/2002 | Gurner | 381/333 |
| 2003/0016840 | A1 | 1/2003 | Sica | |
| 2004/0208325 | A1 * | 10/2004 | Cheung et al. | 381/79 |

FOREIGN PATENT DOCUMENTS

| | | |
|---|---|---|
| WO | WO03073788 | 9/2003 |

* cited by examiner

*Primary Examiner* — Davetta W Goins
*Assistant Examiner* — Kuassi Ganmavo
(74) *Attorney, Agent, or Firm* — Mark M. Friedman

(57) ABSTRACT

Presented herein is a system for transmitting sounds to an in-utero infant, that is worn by a pregnant woman, said system comprising a flexible carrier with two arms and adapted to accommodate the continuously changing shape of the abdomen of a pregnant woman; an array of speakers disposed on the arms of the carrier and substantially surrounding the in-utero infant with the sounds emitted from said speakers; an amplifier operatively associated with the array of speakers that enables tailoring the frequencies and tonal qualities of the sounds emitted from the array of speakers to levels suitable for an in-utero infant; and an audio device, operatively connected to the array of speakers and the amplifier, that provides a source from which sounds are played back.

29 Claims, 5 Drawing Sheets

MUSICAL MATERNITY BELT

CROSS-REFERENCE TO RELATED APPLICATIONS

This application claims the benefit under 35 U.S.C. §119 (e) of U.S. Provisional Patent Application No. 60/835,897 filed Aug. 7, 2006, the content of which is incorporated by reference herein.

FIELD OF INVENTION

This invention relates generally to portable devices for transmitting music and other sounds, and specifically to such devices that are adapted for use with in-utero infants.

BACKGROUND OF THE INVENTION

It is a commonly held belief that an in-utero infant is not only aware of the activities occurring external to the womb, but is able to react to those activities. In particular, research indicates that prenatal infants react to auditory stimuli. A prenatal infant's heartbeat may increase when exposed to loud sounds; the sound of a parent's voice may sooth the infant. It is further thought that auditory stimuli effect fetal growth and brain development, and that music, especially, activates the brain cells and stimulates brain function. According to such studies, in addition to helping a parent develop a bond with the prenatal infant that continues after the birth of the infant, prenatal musical stimulation may offer other postnatal benefits including improved cognitive development and language skills.

In view of these theories, parents may choose to more actively expose their in-utero infants to auditory stimuli. In addition to placing the earphones of a standard headset on either side of a pregnant woman's abdomen, there are a number of other devices available to assist parents who wish to make the most of the potential benefits that auditory stimuli can have on their children.

Illustrative of such devices are WO03073788, US2003016840, and U.S. Pat. No. 5,873,736, incorporated by reference in their entirety herein, each of which discloses a band equipped with one or more speakers that wraps around the torso of a pregnant woman, crossing her abdomen. The speakers may be positioned on the bands such that they direct music or other sounds towards the infant.

SUMMARY OF THE INVENTION

However, none of the above inventions and patents, taken either singularly or in combination, is seen to disclose a device for transmitting music and other auditory sounds and stimuli to an in-utero infant that conforms to the shape of a pregnant woman's abdomen while also comfortably adapting to the changes that occur to her abdomen over the course of the pregnancy, and that enables limiting the sound frequencies to levels that are suitable for the in-utero infant, and whose modular design enables modification to a post natal sound system, as will subsequently be described and claimed in the instant invention.

Presented herein is a musical maternity belt, which provides a portable system for transmitting music and other auditory sounds and stimuli to an in-utero infant.

The design of the carrier comprising the musical maternity belt enables the musical maternity belt to conform to the shape of a pregnant woman's abdomen and additionally allows the musical maternity belt to comfortably adapt to the changing shape of a pregnant woman's abdomen.

An important feature of the musical maternity belt of the present invention is the amplifier that enables limiting the frequencies of the sounds transmitted to the in-utero infant by components of the present invention to levels that are suitable for the in-utero infant. The amplifier may also allow the user to switch the sound frequencies between those levels suitable for the in-utero infant and levels suitable for postnatal use.

Because the musical maternity belt of the present invention has a modular design, one or more the components may be removed from or added to the carrier. This allows the musical maternity belt to be modified for use as a postnatal sound system, for use with various infant accessories such as carriers, strollers, and cribs, and thereby extending the useful life of the present invention.

Accordingly, a system for transmitting sounds to an in-utero infant, that may be worn by a pregnant woman is provided, said system comprising a flexible carrier with an upper and a lower arm; an array of speakers disposed on said upper and lower arms; an amplifier operatively associated with the array of speakers and able to limit the frequencies and tonal qualities of the sounds emitted from the speakers, and an audio device, operatively connected to the speakers and the amplifier, that provides a source from which sounds may be played back; wherein the arrangement of the upper arm relative to the lower arm enables the carrier to accommodate the continuously changing shape of the abdomen of a pregnant woman; the speakers substantially surround the in-utero infant with the sounds emitted from said speakers; and the amplifier enables tailoring the frequencies and tonal qualities of the sounds emitted from the array of speakers to levels suitable for an in-utero infant.

Additionally, the upper arm may be disposed above the lower arm and the two arms may be flexibly conjoined at their ends. Additionally, the upper arm may be adapted to fit over an upper region of the abdomen of a pregnant woman and the lower arm may be adapted to fit over a lower region of the abdomen of a pregnant woman.

The system may further comprise an expandable open area between the upper arm and the lower arm that may be adapted to accommodate the abdomen of a pregnant woman.

The system may further comprise a first band extending from a first conjoined end of the upper and lower arm and a second band extending from a second conjoined end of the upper and lower arm.

The system may further comprise a closure method for fastening the carrier around the abdomen of a pregnant woman. Such a closure method may comprise at least snap, button, buckle, tie, or a hook and loop type fastener. Additionally, such a closure method may be disposed on at least one of the first band and the second band.

The system may further comprise a pocket for receiving an audio device and there may be an opening in the pocket to facilitate coupling a sound reproduction device to the audio device. Such a sound reproduction device may comprise at least one of an earphone, headphones, and an ear bud.

Additionally, the array of speakers comprises at least one group of speakers disposed on the upper arm and at least one group of speakers disposed on the lower arm, and each group of speakers comprises at least one speaker.

Additionally, the speakers may be arranged to enable the in-utero baby to effectively hear the played back sounds from any position.

Additionally, the speakers comprising the array of speakers may be connected in at least on of in parallel and in series. The system may further comprise speaker wires to connect the array of speakers to the amplifier and the audio device. Additionally, alternatively, or both, the connection between the array of speakers, the amplifier and the audio device may be wireless.

The system may further comprise a control module for adjusting the amplifier for prenatal and postnatal use.

Additionally, the audio device may comprise an audio playback component. Such an audio playback component may comprise at least one tuner, cassette player, compact disc (CD) player, or MP3 player.

Additionally, components can be removed from and added to the carrier. The components may include at least one speaker, an amplifier and or audio device.

Additionally, the carrier may be washable.

Additionally, the array of speakers, the amplifier, and the audio device may be removed from the carrier and adapted to postnatal use.

The system may further comprise at least one sound reproduction device to enable at least one user to listen to the sounds being played to the in-utero infant. Such a sound reproduction device may comprise at least one headset, a pair of earphones, a pair of ear buds, or a loudspeaker.

The system may further comprise at least one terminal for engaging the sound reproduction device to the audio device.

The system may further comprise a module for recording and transmitting at least one auditory message to the in-utero infant.

BRIEF DESCRIPTION OF THE FIGURES

The subject matter regarded as the invention will become more clearly understood in light of the ensuing description of embodiments herein, given by way of example and for purposes of illustrative discussion of the present invention only, with reference to the accompanying figures, wherein.

Figure 1:
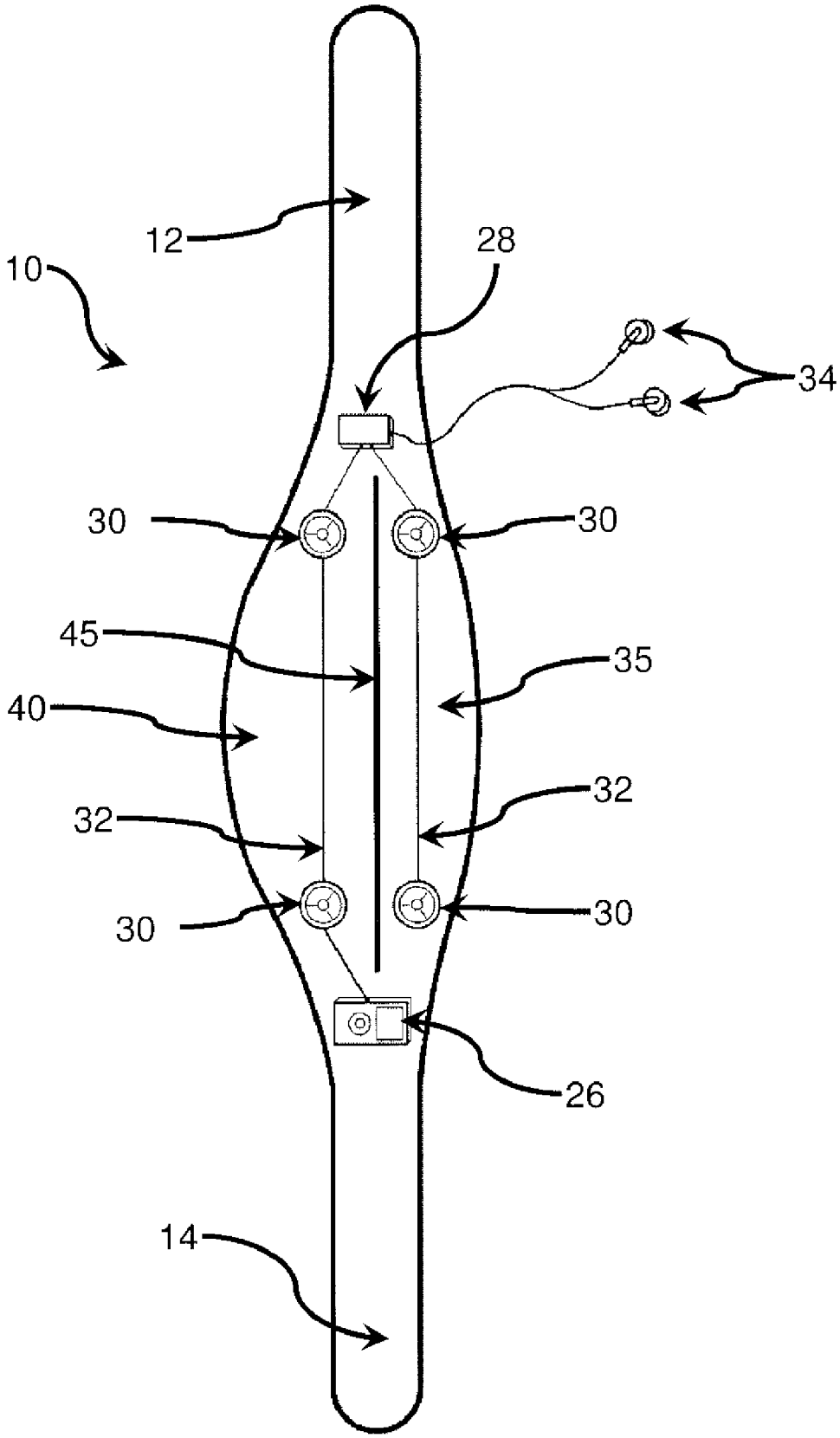
FIG. 1 is an internal view of a musical maternity belt, laid out fiat to show at configuration for a sound system contained therein, according to an embodiment of the present invention.

The figures together with the description make apparent to those skilled in the art how the invention may be embodied in practice.

It will be appreciated that for simplicity and clarity of illustration elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF SOME EMBODIMENTS OF THE INVENTION

The present invention is a musical maternity belt, which provides a modular system for safely transmitting and playing back music and other sounds to an in-utero infant that may be worn by a pregnant woman. This system comprises a sound reproduction system incorporated into a flexible carrier specially adapted to accommodate the continuously changing shape of the abdomen of a pregnant woman.

The sound reproduction system may comprise an array of speakers 30, an audio device 26, and an amplifier 28 that enables limiting and tailoring the tonal ranges and frequencies of the emitted sounds to within suitable and healthy ranges for an in-utero infant. The components comprising the sound reproduction system may also be equipped with a control module for adjusting the sound ranges of amplifier 28 to ranges suitable for prenatal and postnatal use.

The components comprising the sound reproduction system are removable, enabling a user to smoothly switch the present invention between prenatal and postnatal use. Additionally, the modular nature of the present invention allows the user to further customize and expand its use.

The carrier comprises an upper arm 35 and a lower arm 40 flexibly conjoined at their ends and adapted to fit around the abdomen of a pregnant woman 70, and a closure method 60 for easily fastening the carrier around the abdomen of a pregnant woman 70. The arrangement of upper arm 35 relative to lower arm 40 enables carrier 10 to accommodate the continuously changing shape of the abdomen of a pregnant woman 70.

The array of speakers 30 is arranged on upper arm 35 and lower arm 40 such that the in-utero baby is essentially surrounded by the sounds emitted by speakers 30. As a result, regardless of his position, the in-utero baby can always hear the played back sounds.

The resulting musical maternity belt 10 is a self-contained, portable sound system that is comfortable to wear during all stages of a pregnancy and is easily adapted for continued use after the infant is born.

In order to more clearly understand the features and advantages to the present invention, an embodiment of a musical maternity belt is presented in greater detail with reference made to the accompanying drawings.

It is to be understood that an embodiment is an example or implementation of the invention. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature structure, or characteristic described in connection with the embodiments is included in at least one embodiment, but not necessarily all embodiments, of the inventions.

It is understood that the phraseology and terminology employed herein is not to be construed as limiting and is for descriptive purpose only.

The principles and uses of the teachings of the present invention may be better understood with reference to the accompanying description, figures and examples.

It is to be understood that the details set forth herein should not be construed as limiting any applications of the invention.

Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, integers or groups thereof and that the terms are not to be construed as specifying components, features, steps or integers.

The phrase "consisting essentially of", and grammatical variants thereof, when used herein, is not to be construed as excluding additional components, steps, features, integers or groups thereof but rather that the additional features, integers, steps, components or groups thereof do not materially alter the basic and novel characteristics of the claimed composition, device or method.

If the specification or claims refer to "an additional" element, that does not preclude there being more than one of the additional element.

It is to be understood that where the claims of specification refer to "a" or "an" element, such reference is not to be construed as there being only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

The term "method" refers to manners, means, techniques and procedures for accomplishing a given task including, but is not limited to those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

The terms "bottom", "below", "top" and "above" as used herein do not necessarily indicate that a "bottom" component is below a "top" component, or that a component that is "below" is indeed "below" another component or that a component that is "above" is indeed "above" another component. As such, directions, components or both may be flipped, rotated, moved in space, placed in a diagonal orientation or position, placed horizontally or vertically, or similarly modified. Accordingly, it will be appreciated that the terms "bottom", "below", "top" and "above" may be used herein for exemplary purposes only, to illustrate the relative positioning or placement of certain components, to indicate a first and a second component or to do both.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

Figure 6:
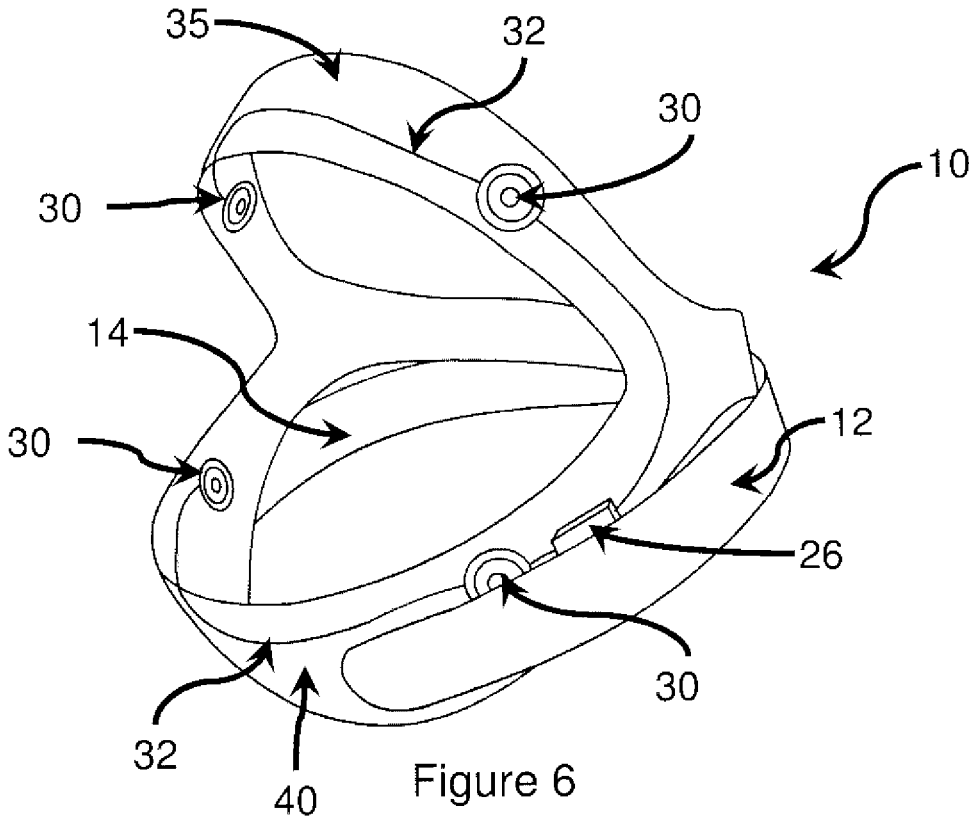
FIG. 6 is a perspective view of a musical maternity belt in the closed position, according to another embodiment of the present invention, showing the arrangement of components of the sound system.
Figure 7:
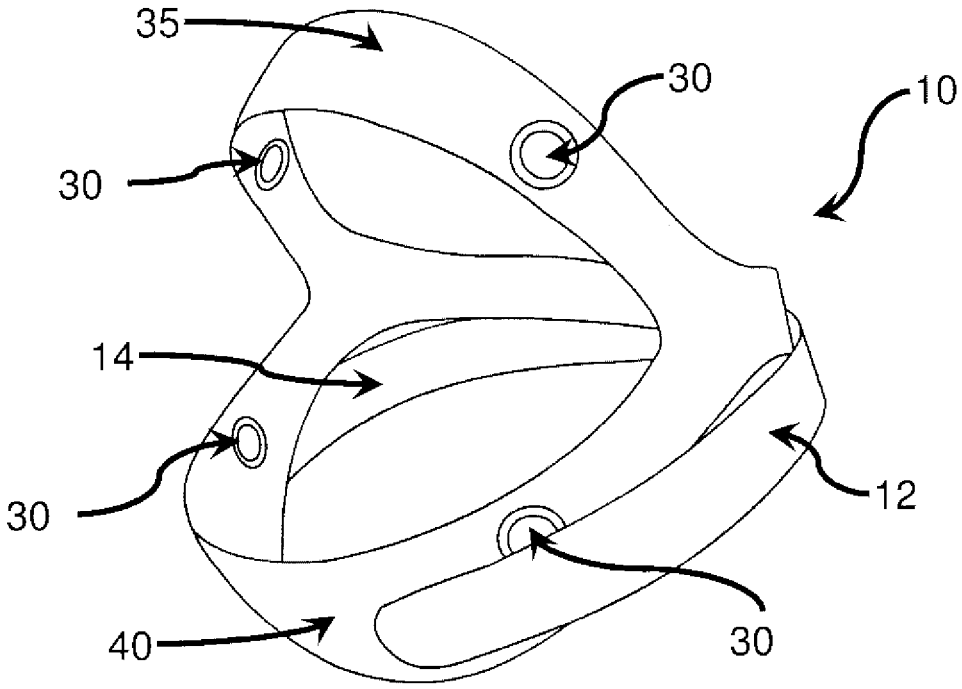
FIG. 7 is a perspective view of a musical maternity belt according to the embodiment of FIG. 6, showing the configuration of an array of speakers.

A carrier 10, according to embodiments of a musical maternity belt of the present invention, comprises at least an upper arm 35, a lower arm 40, and a closure method 60. An embodiment of a carrier 10 for a musical maternity belt according to the present invitation is described in FIGS. 1, 2, 3, and 4, and another embodiment of a carrier 10 for a musical maternity belt according to the present invitation is described in FIGS. 6 and 7. Carrier 10 is also washable.

According to embodiments of a musical maternity belt of the present invention, upper arm 35 may be disposed above lower arm 40 and upper arm 35 and lower arm 40 may be flexibly conjoined at their ends. Upper arm 35 may be adapted to fit over an upper region of the abdomen of a pregnant woman 70 and the lower arm may be adapted to fit over a lower region of the abdomen of a pregnant woman 70.

Carrier 10 may further comprise a first band 12 and a second band 14, which may, for example, be wrapped around the waist of the wearer. According to such embodiments, first band 12 may extend from a first conjoined end of upper arm 35 and lower arm 40 and second band 14 may extend from a second conjoined end of upper arm 35 and lower arm 40, as seen in FIG. 1

According to embodiments of a musical maternity belt of the present invention, an expandable open area 45 may exist between upper arm 35 and lower arm 40 that is adapted to accommodate the abdomen of a pregnant woman 70. Expandable open area 45 may constitute the void formed by the shape of upper arm 35 and lower arm 40. This expandable open area 45 may further ensure that there is room to accommodate the growing belly of the pregnant woman 70. An example of this accommodation is clearly shown in FIG. 2.

Furthermore, said expandable open area 45 diminishes both the bulk and the overall weight of the musical maternity belt.

In some embodiments of the present invention, there is the option of covering expandable open area 45, in order to, for example, provide warmth or greater comfort.

Figure 2:
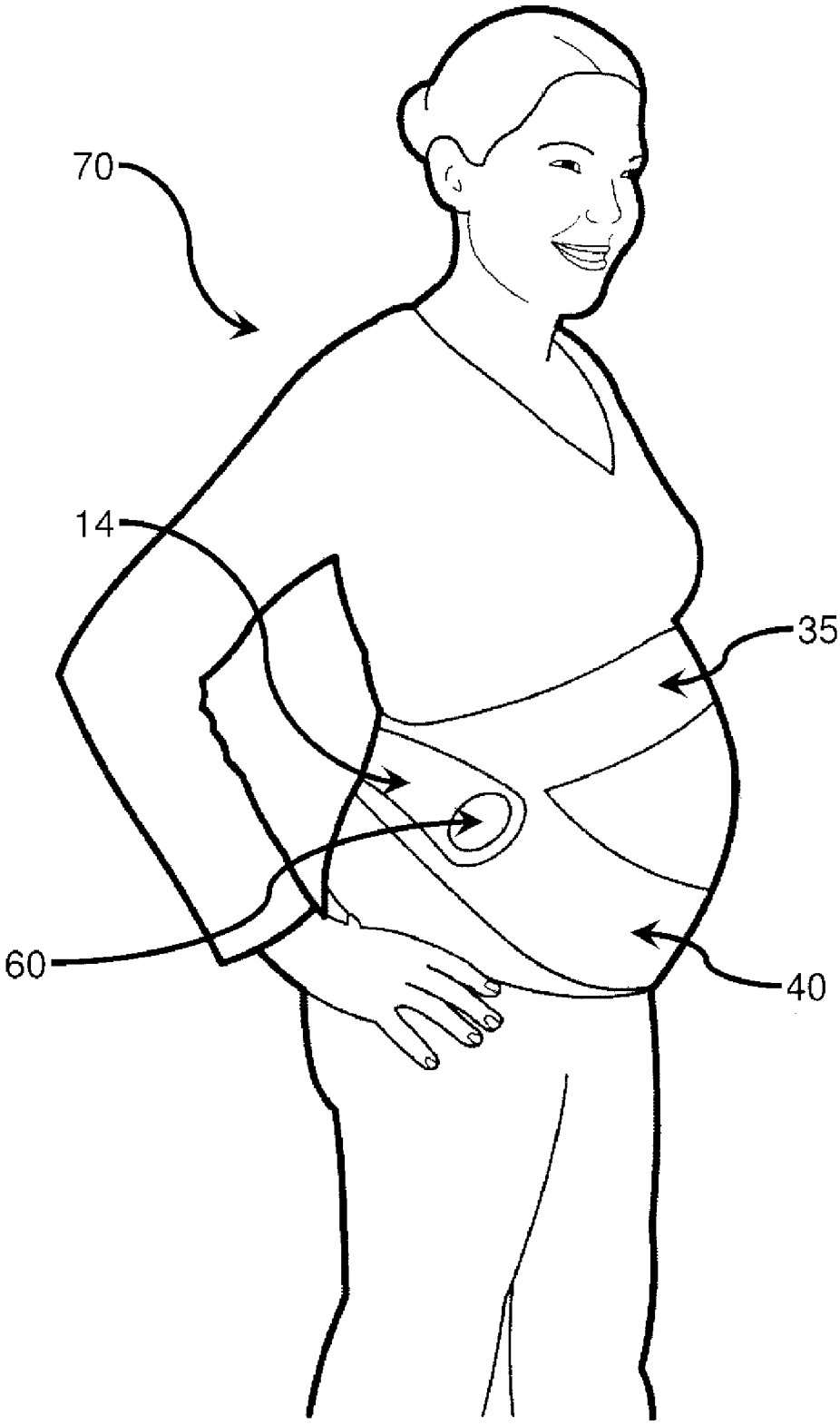
FIG. 2 is a perspective view of a musical maternity belt worn by a pregnant woman, according to an embodiment of the present invention.
Figure 3:
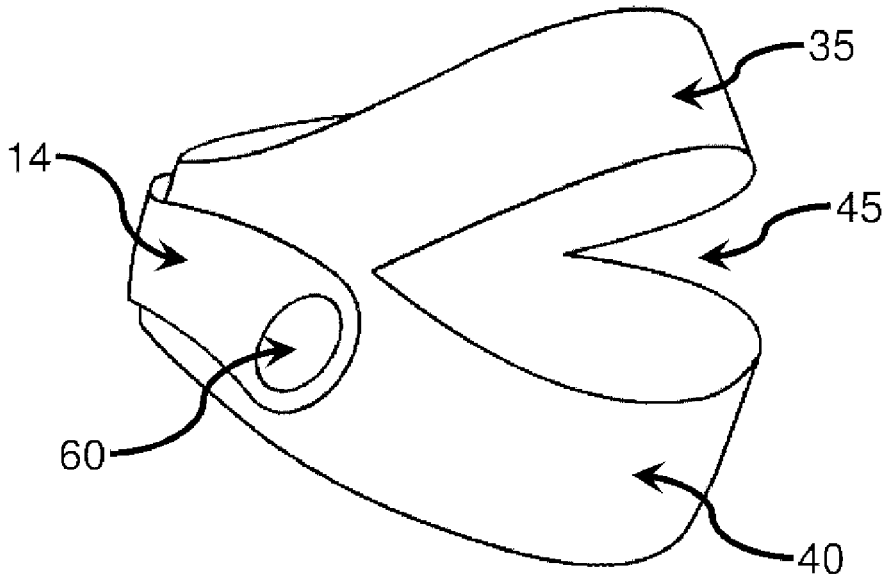
FIG. 3 is a perspective view of a musical maternity belt according to the embodiment of FIG. 2, fastened.
Figure 4:
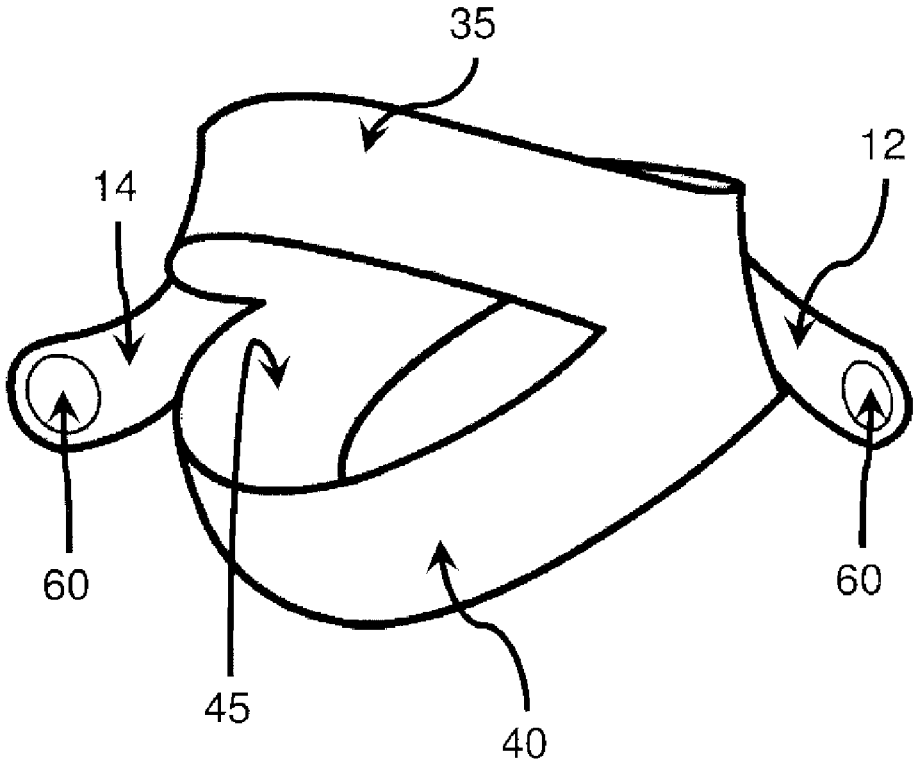
FIG. 4 is a perspective view of a musical maternity belt according to the embodiment of FIG. 2, not fastened.

Closure method 60 for carrier 10 of a musical maternity belt of the present invention enables fastening carrier 10 around the abdomen of a pregnant woman 70. FIG. 2 describes an embodiment of a musical maternity belt fastened around a pregnant woman 70; FIG. 3 is a perspective view of the same embodiment, fastened; and FIG. 4 is a perspective view of the same embodiment, not fastened. Additionally, FIGS. 6 and 7 describe another embodiment of a musical maternity belt, fastened. According to embodiments, closure method 60 may be, inter alia, at least one snap, button, buckle, tie, a hook and loop type fastener, or another type of suitable fastener.

According to some embodiments of the present invention, closure method 60 may be disposed on at least one of first band 12 and second band 14. For example, closure method 60 may comprise a first band 12 outfitted with hook and loop type fastening material and a second band 14 with an opening, wherein first band 12 is passed through the opening on second band 14 and is folded hack to secure the hook and loop type fastening material.

First band 12 and second band 14 of some embodiments of the present invention may be arranged such that first band 12 and second band 14 may be used to fasten carrier 10, for example, at the wearer's back, apron style, rather than at the side In yet other embodiments, first band 12 and second band 14 may be long enough to, for example, be wrapped entirely around the wearer's 70 waist, allowing the wearer to fasten together first band 12 and second band 14 of carrier 10 at a point not at the back or side on the wearer 70.

It is understood that other materials, methods and con figurations may be used for fastening the musical maternity belt of the present invention without departing from the scope of the invention.

According to some embodiments of the present invention, a carrier 10 of the musical maternity belt may be constructed of, for example, three layers of material.

For example, an Inner layer may sit next to the wearer. Accordingly, the side of the inner layer that sits next to the wearer may be constructed of material that will be comfortable and non-chafing. Such material may include, for example, fleece, felt, chamois, and cotton. Additionally, said material may be sufficiently elastic to maintain a flexible, snug fit.

Covering the inner layer there may be a center layer that may, for example, house the various components comprising the sound reproduction system of the musical maternity belt. In order to protect the wearer from the sharp edges of said components, the center layer may be constructed from, for example, a sponge-like or cushiony material. Additionally, said material may be sufficiently elastic to maintain a flexible, snug fit.

According to such an embodiment, carrier in may be covered by an outer layer that is constructed, for example, from sturdy material that provides protection to the underlying components and is also durable.

Additionally, all of the materials of carrier 10 have sufficient elasticity in order to provide a comfortable, snug, and convenient fit that also accommodates the growing belly of the wearer, while also maintaining the shape of carrier 10.

According to some embodiments, the material of one of more of the layers of material comprising carrier 10 may have waterproof or water resistant characteristics, thereby protecting the contained electrical components from moisture damage.

Additionally, according to any of the embodiments of the present invention, some or all of the parts of carrier 10 may be constructed from fire-resistant material or part or all of the material comprising carrier 10 may be treated with fire resistant or fire retardant substances. Furthermore, according to any of the embodiments, some or all of the parts of carrier 10 may be constructed from environmentally friendly materials.

It is understood, furthermore, that other materials and constructions could be used in order to provide a long-lasting, robust, and sturdy carrier 10 for a musical maternity belt of the present invention.

According to some embodiments, carrier 10 of the musical maternity belt may further comprise at least one pocket that may be, for example, of a size that will accommodate, for example, an audio device 26 such as, inter alia, a compact disc player, an MP3 player, a portable radio, and other such devices.

The pocket may, according to some embodiments, have an opening to, for example, facilitate coupling a sound reproduction device to audio device 26. For example, the cable of, for example, a set of earphones 34 may be threaded through to opening for connection to an audio device 26.

According to some embodiments, one or more of the pockets may be internal to the musical maternity belt; according to other embodiments, one or more of the pockets may be located on or accessible, for example, from an outer layer of carrier 10 of the musical maternity belt.

Carrier 10 may be further equipped with a return mechanism, such as a ratchet or other such device, for retracting the cable of, for example, a sound reproduction device, such that the earphones may be stored on the pocket.

It should be understood that neither a pocket nor an opening in the pocket nor a return mechanism are necessary to use the musical maternity belt, and are merely optional features.

The musical maternity belt of the present invention is equipped with an array of speakers 30. An array according to the present invention comprises at least one group of speakers 30 disposed on upper arm 35 and at least one group of speakers 30 disposed on lower arm 40 of carrier 10, wherein each group of speakers 30 comprises at least one speaker 30. The distribution of speakers 30 on upper arm 35 and lower arm 40 is determined to achieve optimal transmission of the sounds from speakers 30 into the abdomen of the wearer 70. Arranging speakers 30 in such a configuration creates the effect of substantially surrounding the in-utero infant with music or other audio stimuli emitted from speakers 30, and ensures that regardless of his position in the abdomen, the in-utero infant is able to hear those audio stimuli.

According to some embodiments, additional speakers 30 may also be placed elsewhere on carrier 10.

It is recommended that speakers 30 be of a flat design, however, speakers 30 may be any type of known in the art speakers that provide a robust means for emitting music and other audio stimuli without departing from the scope of the invention.

According to embodiments of the musical maternity belt of the present invention, speakers 30 are removably disposed on carrier 10. For example, according to embodiments of a carrier 10 that comprise, for example, an inner and an outer layer of material, array of speakers 30 may be disposed, for example, between the inner and outer layers of material. According to other embodiments of a carrier 10 that comprise, for example, three or more layers of material, array of speakers 30 may be removably affixed to, for example, an inner layer. It is understood that speakers 30 may also be disposed elsewhere on carrier 10 without departing from the scope of the present invention.

Speakers 30 may be connected in parallel or in series or in a combination of both. For example, each speaker 30 within a group may, for example, be connected in parallel and the groups comprising the array of speakers 30 may, for example, be connected in series or all of speakers 30 may be connected in series. According to some other embodiments, speaker wires 32 may, for example, all join together at one spot and lead to a terminal for connecting speakers 30 to amplifier 28.

An amplifier 28, according to embodiments of the musical maternity bell of the present invention, may be operatively associated with the array of speakers 30.

Amplifier 28 is able to tailor and limit the frequencies and tonal qualities of the music and other sounds emitted from speakers 30 to levels suitable for an in-utero infant.

According to embodiments of the musical maternity belt of the present invention, amplifier 28 may further comprise a control module for adjusting the frequencies, tonal qualities, and other sound ranges between those that are suitable for prenatal use and those that are suitable postnatal use.

An audio device 26, according to embodiments of the present invention, plays back the desired music and other audio stimuli. According to embodiments of a musical maternity belt of the present invention, an audio device 26 may comprises any type of sound source or audio playback component, such as, inter alia, a tuner, a cassette player, a compact disc (CD) player, or an MP3 player. According to some embodiments, a musical maternity belt of the present invention 10 may be equipped with more than one audio device 26.

Figure 5:
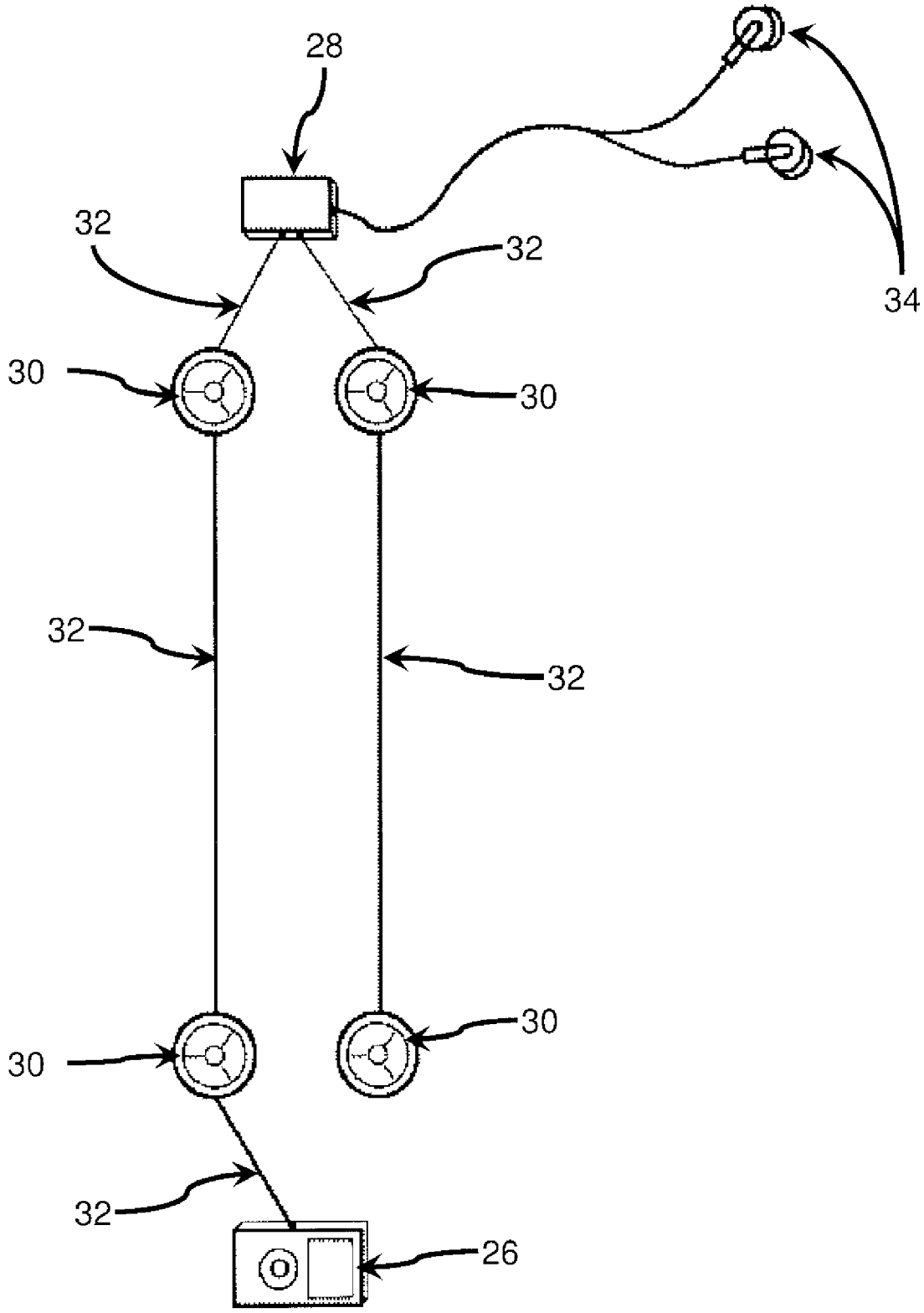
FIG. 5 is a schematic view of the components of the sound system according to the embodiment of FIG. 1, including an array of speakers, an audio device, and an amplifier.

According to some embodiments of the musical maternity belt of the present invention, the connection between the array of speakers 30, amplifier 28, and audio device 26 is a wired connection. For example, musical maternity belt of the present invention may further comprise speaker wires 32 to connect speakers 30 to amplifier 28 and audio device 26. Such an arrangement is shown in FIGS. 1 and 5. According to some other embodiments, the connection is wireless. According to yet embodiments, the connection between the array of speakers 30, amplifier 28, and audio device 26 may be a combination of wired and wireless connections.

Additionally or alternatively, additional connection means may be provided to allow the musical maternity belt to connect to more than one audio device 26, including, inter alia, a compact disc player, a radio, an MP3 player, and other such devices.

Optionally, the musical maternity belt may further comprise at least one sound reproduction device, such as, inter alia, a pair of earphones 34, a headset, a pair of ear buds, or a loudspeaker, to enable at least one user to listen to the sounds being played to the in-utero infant. Additionally, there may be at least one terminal for coupling earphones 34 or another sound reproduction or listening device to, for example, audio device 28, enabling the wearer, and optionally others, to hear the same sounds as the in-utero baby hears. It should be understood that a sound reproduction device are not necessary to use the musical maternity belt, and is merely an optional feature.

According to some embodiments of the present invention, the musical maternity belt may further comprise a module for recording and transmitting at least one auditory message to the in-utero infant. It should be understood that such a module is not necessary to use musical maternity belt and is merely an optional feature.

In order to more fully describe the present invention, the following describes a mode of use.

The mother 70 first ensures that amplifier 28 is set for prenatal use, wherein ensures that the delivered sounds are suitable for an in-utero infant.

The mother 70 then positions carrier 10 so that her abdomen protrudes through expandable open area 45, with upper arm 35 sittings comfortably on the upper section of her abdomen, and lower arm 40 sittings comfortably under the lower area of her abdomen.

The mother 70 may then secure carrier 10 in place according to a closure method 60 as described above or according to any other suitable closure method 60.

The musical maternity belt is easily adjusted to accommodate the abdomen at any stage of pregnancy by arranging upper arm 35 and lower arm 40 so that the size and shape of expandable open area 45 adapts to the size and shape of the abdomen of the mother 70. According to some embodiments, additional adjustments, such as, for example, tightening or loosening closure method 60, may also be made.

Once band 12 is secured, musical maternity belt 10 is ready to transmit music or other audio stimuli to the in-utero infant.

The musical maternity belt is modular and at least one component, including a speaker 30, an amplifier 28, and an audio device 26, may be removed, added, moved, or otherwise customized. This allows the mother 70 to customize the musical maternity belt by, for example, adding additional speakers, exchanging audio devices 26 or otherwise varying the sound system components, as desired.

When the infant is born, and in-utero audio stimulus is no longer required, the mother 70 has the option of adapting the musical maternity belt for postnatal use. According to some embodiments, the mother 70, or other user, may use, for example, the control module to adjust amplifier 28 for postnatal use.

The components comprising the sound system, including speakers 30, amplifier 28, audio device 26, and speaker wires 32, may be removed from carrier 10 and adapted for postnatal use, resulting in a harness system as seen, for example, in FIG. 5. This harness system may also be further customized as described above, in order to, for example, accommodate the requirements dictated by the intended postnatal use.

Once adapted for its intended postnatal use, the harness system may be disposed on, inter alia, a baby carriage, a crib, a stroller, an umbrella, or any other devices in which or near which an infant, for example, may be situated or located. Additionally, the harness system may be used in other listening situations.

The components comprising the sound system of the musical maternity belt, i.e., harness system, may also be reinserted into carrier 10, configured again for use as a portable system for transmitting music and other auditory sounds and stimuli to an in-utero infant.

While the invention has been described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents. Therefore, it is to be understood that alternatives, modifications, and variations of the present invention are to be construed as being within the scope and spirit of the appended claims.

What is claimed is:

1. A system for transmitting sounds to an in-utero infant, which is worn by a pregnant woman, said system comprising a single-piece flexible carrier with an opening in the center, the opening creating an upper arm and a lower arm, the upper arm and the lower arm each comprised of expandable material having sufficient elasticity to allow the single-piece flexible carrier to assume a substantially flat position and to assume a curved expanded position;

an array of speakers disposed on said upper and lower arms;

an amplifier operatively associated with the array of speakers that is able to limit the frequencies and tonal qualities of the sounds emitted from the speakers; and an audio device, operatively connected to the speakers and the amplifier, that provides a source from which sounds are played back; wherein the arrangement of the upper arm relative to the lower arm enables the carrier to accommodate the continuously changing shape of the abdomen of a pregnant woman; the speakers substantially surround the in-utero infant with the sounds emitted from said speakers;

and the amplifier enables tailoring the frequencies and tonal qualities of the sounds emitted from the array of speakers to levels suitable for an in-utero infant.

2. The system according to claim 1, wherein the upper arm is disposed above the lower arm and the upper arm and lower arm are flexibly conjoined at their ends.

3. The system according to claim 2, wherein the upper arm is adapted to fit over an upper region of the abdomen of a pregnant woman and the lower arm is adapted to fit over a lower region of the abdomen of a pregnant woman.

4. The system according to claim 1, further comprising a closure method for fastening the carrier around the abdomen of a pregnant woman.

5. The system according to claim 4, wherein the closure method is at least one of a snap, a button, a buckle, a tie, and a hook and loop type fastener.

6. The system according to claim 4, wherein the closure method is disposed on at least one of the first band and the second band.

7. The system according to claim 1, further comprising a pocket for receiving an audio device.

8. The system according to claim 7, further comprising an opening in the pocket to facilitate coupling a sound reproduction device to the audio device.

9. The system according to claim 8, wherein the sound reproduction device is at least one of an earphone, headphones, and an ear bud.

10. The system according to claim 1, wherein the array of speakers comprises at least one group of speakers disposed on the upper arm and at least one group of speakers disposed on the lower arm, wherein each group of speakers comprises at least one speaker.

11. The system according to claim 1, wherein the speakers are arranged to enable the in-utero baby to hear the played back sounds from any position.

12. The system according to claim 1, wherein the speakers comprising the array of speakers are of flat design and connected in at least one of in parallel and in series.

13. The system according to claim 12, further comprising speaker wires to connect the array of speakers to the amplifier and the audio device.

14. The system according to claim 12, wherein the connection between the array of speakers, the amplifier and the audio device is wireless.

15. The system according to claim 1, further comprising a control module for adjusting the amplifier for prenatal and postnatal use.

16. The system according to claim 1, wherein the audio device comprises an audio playback component.

17. The system according to claim 16, wherein the audio playback component is at least one of a tuner, a cassette player, a compact disc (CD) player, and an MP3 player.

18. The system according to claim 1, wherein components can be removed from and added to the carrier.

19. The system according to claim 18, wherein the components includes at least one of a speaker, an amplifier and an audio device.

20. The system according to claim 1, wherein the carrier is washable.

21. The system according to claim 1, wherein the array of speakers, the amplifier and the audio device are removed from the carrier and adapted to postnatal use.

22. The system according to claim 1, further comprising at least one sound reproduction device to enable at least one user to listen to the sounds being played to the in-utero infant.

23. The system according to claim 22, wherein the sound reproduction device is at least one of a headset, a pair of earphones, a pair of ear buds, and a loudspeaker.

24. The system according to claim 23, further comprising at least one terminal for engaging the sound reproduction device to the audio device.

25. The system according to claim 1, further comprising a module for recording and transmitting at least one auditory message to the in-utero infant.

26. An apparatus for transmitting sounds to an in-utero infant, the apparatus worn by a pregnant woman and comprising a single-piece flexible carrier with an opening in the center, the opening creating an upper arm and a lower arm, the upper arm disposed above the lower arm and the upper and lower arms flexibly conjoined at their ends, the upper arm and the lower arm each comprised of expandable material having sufficient elasticity to allow the single-piece flexible carrier to assume a substantially flat position and to assume a curved expanded position, an arrangement of the upper arm relative to the lower arm including an expandable open area between the upper arm and the lower arm that is configured to accommodate the abdomen of the pregnant woman and to allow the carrier to accommodate the continuously changing shape of the abdomen;

an array of speakers disposed on said upper and lower arms, each of the speakers in the array being of a flat design;

an amplifier operatively associated with the array of speakers that is able to limit the frequencies and tonal qualities of the sounds emitted from the speakers; and an audio device, operatively connected to the speakers and the amplifier, that provides a source from which sounds are played back; wherein the speakers substantially surround the in-utero infant with the sounds emitted from said speakers;

and the amplifier enables tailoring the frequencies and tonal qualities of the sounds emitted from the array of speakers to levels suitable for an in-utero infant.

27. An apparatus for transmitting sounds to an in-utero infant, the apparatus worn by a pregnant woman and comprising a single-piece flexible carrier with an opening in the center, the opening creating an upper arm and a lower arm, the upper arm and the lower arm each comprised of expandable material having sufficient elasticity to allow the single-piece flexible carrier to assume a substantially flat position and to assume a curved expanded position, a first band extending from a first conjoined end of the upper and lower arm and a second band extending from a second conjoined end of the upper and lower arm;

an array of speakers disposed on said upper and lower arms;

an amplifier operatively associated with the array of speakers that is able to limit the frequencies and tonal qualities of the sounds emitted from the speakers; and an audio device, operatively connected to the speakers and the amplifier, that provides a source from which sounds are played back; wherein the arrangement of the upper arm relative to the lower arm enables the carrier to accommodate the continuously changing shape of the abdomen of the pregnant woman;

the speakers substantially surround the in-utero infant with the sounds emitted from said speakers;

and the amplifier enables tailoring the frequencies and tonal qualities of the sounds emitted from the array of speakers to levels suitable for an in-utero infant.

28. A method of transmitting sounds to an infant during prenatal and postnatal stages using a single carrier, comprising (a) providing a pregnant woman with a single-piece flexible carrier with an opening in the center, the opening creating an upper arm and a lower arm, the upper arm and the lower arm each comprised of expandable material having sufficient elasticity to allow the single-piece flexible carrier to assume a substantially flat position and to assume a curved expanded position, the carrier also having an array of speakers disposed on said upper and lower arms, an amplifier operatively associated with the array of speakers that is able to limit the frequencies and tonal qualities of the sounds emitted from the speakers, and an audio device, operatively connected to the speakers and the amplifier, that provides a source from which sounds are played back, wherein the arrangement of the upper arm relative to the lower arm enables the carrier to accommodate the continuously changing shape of the abdomen of a pregnant woman; the speakers substantially surround the in-utero infant with the sounds emitted from said speakers, and the amplifier enables tailoring the frequencies and tonal qualities of the sounds emitted from the array of speakers to levels suitable for an in-utero infant;

(b) having the woman wear the carrier during an early part of her pregnancy with the single-piece flexible carrier assuming a substantially flat position that provides a snug fit for her belly;

(c) having the woman wear the carrier during a later part of her pregnancy with the single-piece flexible carrier assuming a curved expanded position that provides a snug fit for her belly; and (d) removing the array of speakers, the amplifier and the audio device from the carrier and using a control module to adjust the amplifier for post natal use.

29. The method of claim 28, further comprising reinserting the array of speakers, the amplifier and the audio device into the carrier and using a control module to adjust the amplifier for prenatal use during a new pregnancy.

* * * * *